US007198067B2

(12) United States Patent
Collegnon

(10) Patent No.: US 7,198,067 B2
(45) **Date of Patent: *Apr. 3, 2007**

(54) WARP-RUNNER TRIPLE LAYER FABRIC WITH PAIRED INTRINSIC WARP BINDERS

(75) Inventor: Jeffrey Joseph Collegnon, Combined Locks, WI (US)

(73) Assignee: Albany International Corp., Albany, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/191,779

(22) Filed: Jul. 28, 2005

(65) Prior Publication Data

US 2006/0048837 A1 Mar. 9, 2006

Related U.S. Application Data

(60) Provisional application No. 60/598,887, filed on Aug. 4, 2004.

(51) Int. Cl.
*D21F 7/08* (2006.01)
*D03D 25/00* (2006.01)

(52) U.S. Cl. ..... 139/383 A; 139/408; 139/413; 139/414; 139/415; 162/358.2; 162/900

(58) Field of Classification Search ..... 139/383 A, 139/408, 413, 414, 415; 162/358.2, 900
See application file for complete search history.

(56) References Cited

U.S. PATENT DOCUMENTS 4,376,455 A 3/1983 Hahn
4,438,788 A 3/1984 Harwood
4,564,051 A 1/1986 Odenthal
4,564,052 A * 1/1986 Borel ..... 139/425 A
4,611,639 A 9/1986 Bugge
4,821,780 A 4/1989 Tate
5,054,525 A 10/1991 Vohringer
5,277,967 A 1/1994 Zehle et al.
5,429,686 A * 7/1995 Chiu et al. ..... 139/383 A
5,694,980 A * 12/1997 Quigley ..... 139/383 A (Continued)

FOREIGN PATENT DOCUMENTS

DE 298 07 274 U 1 8/1998
EP 1 195462 A 4/2002
WO WO 01/02634 A 1/2001

*Primary Examiner*—Robert H Muromoto
(74) *Attorney, Agent, or Firm*—Frommer Lawrence & Haug LLP; Ronald R. Santucci

(57) ABSTRACT

A papermaker's fabric, usable in a forming section of a paper machine, having a first layer formed of a first system of paired machine-direction (MD) warp yarns interwoven with a first system of cross machine-direction (CD) weft yarns and a second layer formed of a second system of MD warp yarns interwoven with a second system of CD weft yarns. The paired MD warp yarns are intrinsic to the first layer and are interwoven with the second system of CD weft yarns to bind the second layer to the first layer. The second system of MD warp yarns forms long floats, or warp-runners, on an external surface of the second layer. In this manner, a triple layer forming fabric with paired intrinsic binders and warp-runners may be produced with improved wear side abrasion resistance.

13 Claims, 2 Drawing Sheets

U.S. PATENT DOCUMENTS 5,826,627 A 10/1998 Seabrook et al.
5,881,764 A 3/1999 Ward
6,158,478 A 12/2000 Lee et al.
6,202,705 B1 3/2001 Johnson et al.
6,253,796 B1 7/2001 Wilson et al.
6,834,684 B2 * 12/2004 Martin et al. ..... 139/383 A
6,896,009 B2 * 5/2005 Ward ..... 139/383 A
7,007,722 B2 * 3/2006 Quigley et al. ..... 139/383 A
7,048,012 B2 * 5/2006 Martin et al. ..... 139/383 A
7,059,357 B2 * 6/2006 Ward ..... 139/348
2004/0118473 A1 6/2004 Hay et al.
2005/0139281 A1 6/2005 Martin et al.

* cited by examiner

WARP-RUNNER TRIPLE LAYER FABRIC WITH PAIRED INTRINSIC WARP BINDERS

CROSS-REFERENCE TO RELATED APPLICATIONS

This application is based upon and claims the benefit of U.S. Provisional Patent Application Ser. No. 60/598,887 filed Aug. 4, 2004 entitled "WARP-RUNNER TRIPLE LAYER FABRIC WITH PAIRED INTRINSIC WARP BINDERS", the disclosure of which is incorporated herein by reference.

BACKGROUND OF THE INVENTION

1. Field of the Invention

The present invention relates to the papermaking arts. More specifically, the present invention relates to forming fabrics for a forming section of a paper machine.

2. Description of the Prior Art

During the papermaking process, a cellulosic fibrous web is formed by depositing a fibrous slurry, that is, an aqueous dispersion of cellulose fibers, onto a moving forming fabric in a forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The design of forming fabrics additionally involves a compromise between the desired fiber support and fabric stability. A fine mesh fabric may provide the desired paper surface properties, but such design may lack the desired stability resulting in a short fabric life. By contrast, coarse mesh fabrics provide stability and long life at the expense of fiber support. To minimize the design tradeoff and optimize both support and stability, multi-layer fabrics were developed. For example, in double and triple layer fabrics, the forming side is designed for support while the wear side is designed for stability, as well as drainage.

In addition, triple layer designs allow the forming surface of the fabric to be woven independently of the wear surface. Because of this independence, triple layer designs can provide a high level of fiber support and an optimum internal void volume. Thus, triple layers may provide significant improvement in drainage over single and double layer designs.

Essentially, triple layer fabrics consist of two fabrics, the forming layer and the wear layer, held together by binding yarns. The binding is extremely important to the overall integrity of the fabric. One problem with triple layer fabrics has been relative slippage between the two layers which breaks down the fabric over time. In addition, the binding yarns can disrupt the structure of the forming layer resulting in marking of the paper.

The present invention describes a triple-layer forming fabric having paired intrinsic binders and wear side warp runners. The present invention provides a solution to the problem of abrasive wear on the machine side of the fabric while providing good fiber support with a relatively low caliper and an appropriate void volume.

SUMMARY OF THE INVENTION

Accordingly, the present invention relates to a forming fabric for use in the forming section of a paper machine, although it may find application in the pressing and/or drying sections of the paper machine.

The present fabric is a triple layer forming fabric having a first layer formed of a first system of paired machine-direction (MD) warp yarns interwoven with a first system of cross machine-direction (CD) weft yarns and a second layer formed of a second system of MD warp yarns interwoven with a second system of CD weft yarns. The paired MD warp yarns are intrinsic to the first layer and are interwoven with the second system of CD weft yarns to bind the second layer to the first layer. The second system of MD warp yarns forms long floats, or warp-runners, on an external surface of the second layer. The first layer is a forming side of the fabric and the second layer is a wear side of the fabric. In this manner, a triple layer forming fabric with paired intrinsic binders and warp-runners may be produced with improved wear side abrasion resistance.

Another aspect of the present fabric is that the paired MD warp runners are not intrinsic to the first layer. The second layer of paired warp runners help to protect the binding point(s) between the layers. Because each wear weft passes under at least two consecutive wear warps, the wear warps can be wrapped more forcefully to create a greater plane difference than comparable prior art fabrics.

Other aspects of the present invention include that the fabric may have various weft ratios of the first system of CD weft yarns to the second system of CD weft yarns. The long floats may be of different lengths. The fabric may be flat woven or in endless form. Some of the yarns may have different diameters and/or shapes.

The present invention will now be described in more complete detail with frequent reference being made to the drawing figure, which is identified below.

BRIEF DESCRIPTION OF THE DRAWING

For a more complete understanding of the invention, reference is made to the following description and accompanying drawing, in which.

DETAILED DESCRIPTION OF THE PREFERRED EMBODIMENTS

A preferred embodiment of the present invention describes a triple-layer fabric suitable for use in the forming section of a papermaking machine. The present fabric is comprised of a top, or forming, layer and a bottom, or wear, layer. Each layer is formed of interwoven machine direction (MD), or warp, yarns and cross-machine direction (CD), or weft yarns. Hence, the fabric is made up of forming wefts and wear wefts with forming warps and wear warps.

The forming layer and wear layer are bound together by the forming warps which are interwoven with both the forming wefts and wear wefts. These forming warps are paired together and are intrinsic to at least the forming layer, and possibly both layers. Thus, they are referred to as paired intrinsic binders. Here, the term intrinsic is defined to mean the yarns are woven so as to provide fiber support to the top layer, as opposed to simply binding one layer to another.

Another feature of the present invention is that the warps in the wear layer of the fabric are woven so as to produce long floats on the outer wear side surface of the triple layer fabric. Here, a "long" float means the warp passes under at least two wefts on the wear side surface. Accordingly, such long floats may pass under or beneath 2, 3, 4, or more yarns on the wear side. These long floats are alternatively referred to as warp runners. The floats are the primary contacts between the fabric and the papermaking machine. Various warps or combinations of warps can also be used to form the floats; e.g. wear side warps, or forming side warps, or both the wear side warps and the forming warps can be used to form warp runners. Further, each of the wear side warps and/or forming side warps or only some of them can be used to form warp runners. The length of the floats can also be varied. Because these floats run in the MD and provide a relatively smooth fabric surface, they reduce the abrasive wear on the fabric caused by contact with stationary elements of the papermaking machine. In other words, the present fabric's warp runners provide improved abrasion resistance.

Figure 1:
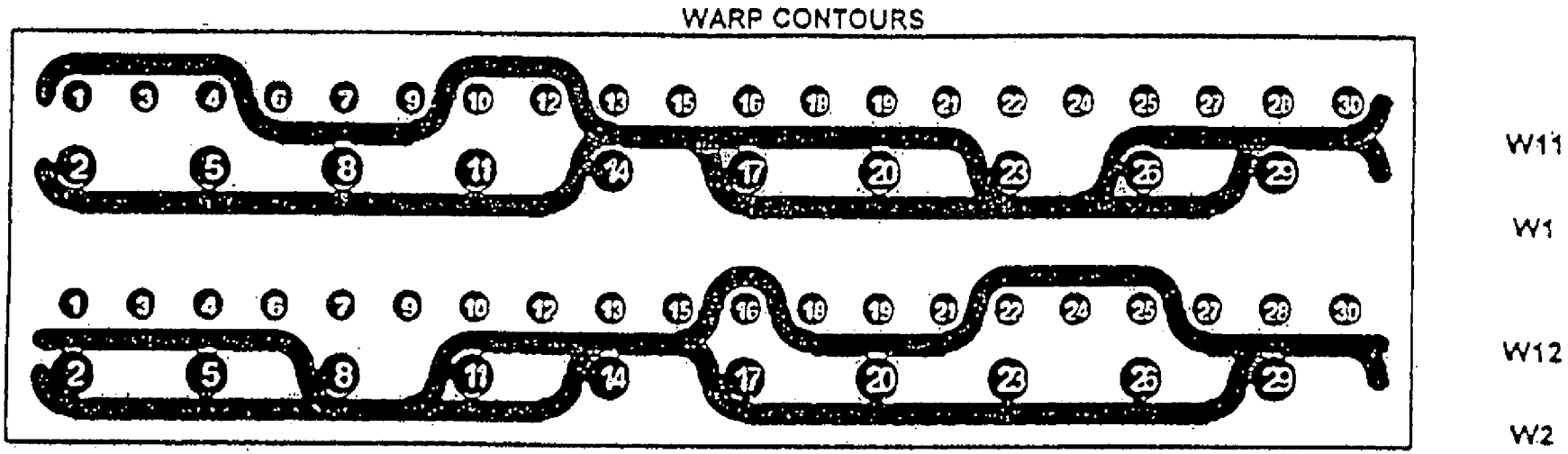
FIG. 1 shows a cross-sectional view of a preferred embodiment of a warp-bound warp-runner triple layer fabric with paired intrinsic binders and paired warp runners in accordance with the teachings of the present invention.

FIG. 1 shows a cross-sectional view of the preferred embodiment of a warp-runner triple layer fabric with paired intrinsic warp binders in accordance with the teachings of the present invention. More specifically, FIG. 1 shows the warp contours in the forming and wear layers for a pair of intrinsic binder yarns W11 and W12. Paired warps W11 and W12 are woven intrinsic to the forming layer and cross to bind the wear layer. Warp W11 binds the wear layer at weft yarn 23 and warp W12 binds the wear layer at weft yarn 8. The fabric has a weft ratio of 2:1 as evidenced by twice as many weft yarns in the forming layer (e.g. 1, 3, 4, . . . ) as in the wear layer (e.g. 2, 5, 8, . . . ). Wear warp W1 and wear warp W2 weave the wear layer and form paired warps with long floats from weft yarns 2 to 11 and 17 to 26. Although a float length of 4 is illustrated in FIG. 1, other float lengths greater than 2 can be utilized. Further, the wear warps may be paired warps and/or non-paired warps.

Additional advantages of the present fabric include a relatively high weaving efficiency, reduced dimples on the forming surface (primarily due to the use of binding warps rather than wefts), a relatively low caliper and an appropriate void volume. The present fabric is also relatively easy to clean, has a relatively long life expectancy, and a relatively low drive load for papermaking machines running this fabric due to the long wear side floats contacting the machine elements in a perpendicular direction.

Other aspects of the present invention include that the pattern may have forming to wear-side weft ratios of 1:1, 2:1, 3:1, 3:2, or any other weft ratio. The present fabric may also incorporate different diameter or shaped yarns. For example, the forming side yarns may be of a smaller diameter than the wear side yarns. Various combinations of warp and weft yarn sizes may also be used. Additionally, warp and/or weft yarns may be stacked or not stacked. For example, the forming side wefts may be stacked or not stacked over the wear side wefts. Note, these examples are simply representative examples of the invention and are not meant to limit the invention.

The fabric according to the present invention preferably comprises only monofilament yarns. The CD and MD yarns may have a circular cross-sectional shape with one or more different diameters. Additionally, the CD yarns and MD yarns in the forming side and wear side may have different diameters. It is preferable for the forming side CD and MD yarns to have smaller diameters than the wear side CD and MD yarns. However, various combinations of yarn diameters can be used in the present invention. Further, in addition to a circular cross-sectional shape, one or more of the yarns may have other cross-sectional shapes such as a rectangular cross-sectional shape or a non-round cross-sectional shape.

The yarns may be monofilament yarns of circular cross section of any of the synthetic polymeric resins used in the production of such yarns for paper machine clothing. Polyester and polyamide are but two examples of such materials.

Modifications to the above would be obvious to those of ordinary skill in the art, but would not bring the invention so modified beyond the scope of the present invention. The claims to follow should be construed to cover such situations.

What is claimed is:

1. A papermaker's fabric comprising:

a first layer formed of a first system of paired machine-direction (MD) warp yarns interwoven with a first system of cross machine-direction (CD) weft yarns; and a second layer formed of a second system of MD warp yarns interwoven with a second system of CD weft yarns;

wherein the paired MD warp yarns are intrinsic to said first layer or said second layer, and are interwoven with said second system of CD weft yarns to bind said second layer to said first layer;

wherein the second system of MD warp yarns forms long floats on an external surface of said second layer.

2. The papermaker's fabric according to claim 1, wherein the fabric is a triple layer forming fabric.

3. The papermaker's fabric according to claim 1, wherein the first layer is a forming side of the fabric and the second layer is a wear side of the fabric.

4. The papermaker's fabric according to claim 1, wherein the long floats on said external surface improve abrasion resistance of the fabric.

5. The papermaker's fabric according to claim 1, wherein the fabric has a 2:1 weft ratio of said first system of CD weft yarns to said second system of CD weft yarns.

6. The papermaker's fabric according to claim 1, wherein the fabric has a 1:1 weft ratio of said first system of CD weft yarns to said second system of CD weft yarns.

7. The papermaker's fabric according to claim 1, wherein the yarns of each long float pass beneath at least two CD weft yarns of the second system.

8. The papermaker's fabric according to claim 1, wherein the fabric may be flat woven or in endless form.

9. The papermaker's fabric according to claim 1, wherein some of the yarns have different diameters.

10. The papermaker's fabric according to claim 1, wherein at least some of the yarns have a non-round cross-sectional shape.

11. The papermaker's fabric according to claim 1, wherein some of the MD warp yarns are one of polyamide yarns or polyester yarns.

12. The papermaker's fabric according to claim 1, wherein some of the CD weft yarns are one of polyamide yarns or polyester yarns.

13. The papermaker's fabric according to claim 1, wherein the paired MD warp yarns are intrinsic to said first layer and said second layer.

* * * * *

UNITED STATES PATENT AND TRADEMARK OFFICE

CERTIFICATE OF CORRECTION

Figure 2:
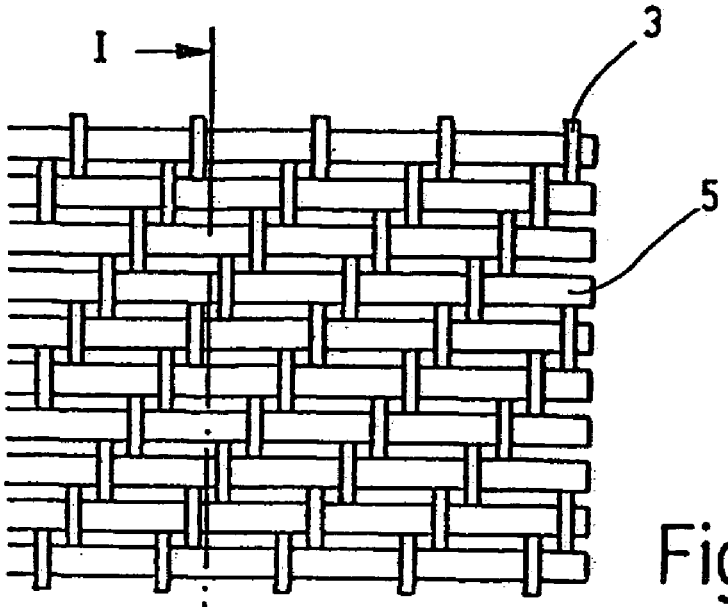
Figure 3:
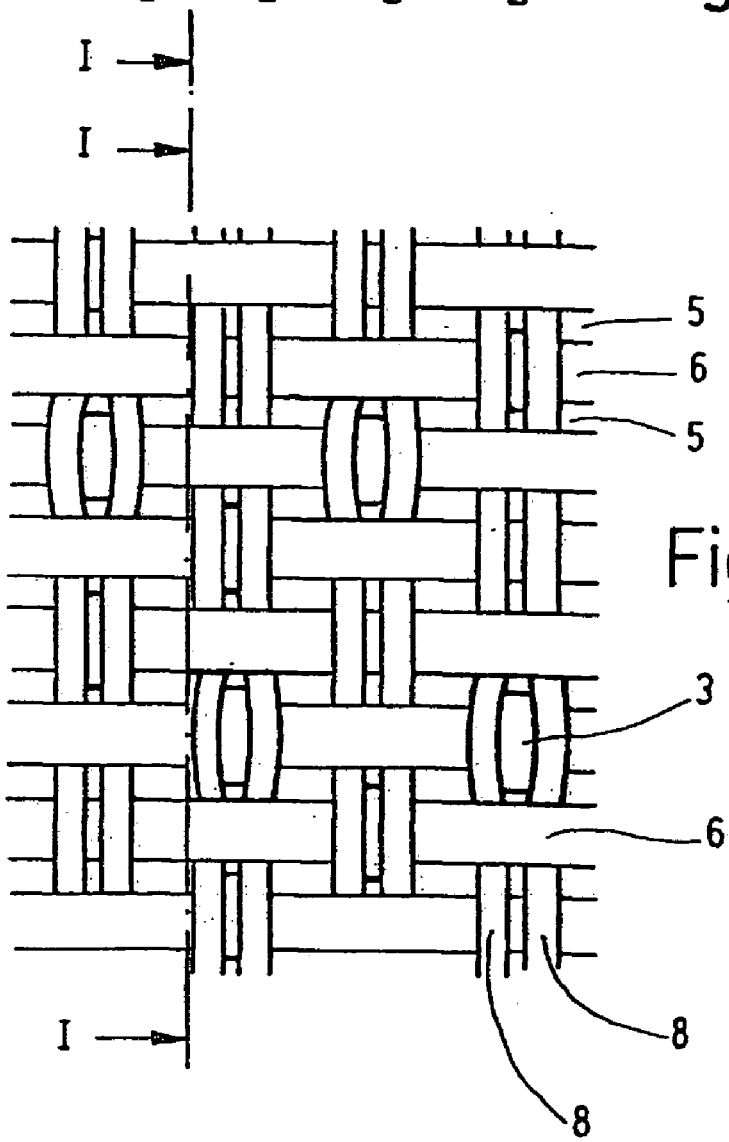

PATENT NO. : 7,198,067 B2
APPLICATION NO. : 11/191779
DATED : April 3, 2007
INVENTOR(S) : Jeffrey Joseph Collegnon It is certified that error appears in the above-identified patent and that said Letters Patent is hereby corrected as shown below:

Drawings:

Delete Drawing Sheet 2 of 2, consisting of Figures 2 and 3.

Signed and Sealed this

Twenty-seventh Day of November, 2007

JON W. DUDAS
*Director of the United States Patent and Trademark Office*